US005099177A

United States Patent [19]

Taniguchi et al.

[11] Patent Number: 5,099,177

[45] Date of Patent: Mar. 24, 1992

[54] LAMP CIRCUIT WITH DISCONNECTED LAMP DETECTING DEVICE

[75] Inventors: Shozo Taniguchi, Hinode; Tomonori Okabe, Machida; Ryoji Doya, Tokyo; Kazutoyo Narita, Itsukaichi; Kiyoshi Noda, Hachioji; Katsuyuki Ueda, Soka, all of Japan

[73] Assignee: Kabushiki Kaisha Toshiba, Kawasaki, Japan

[21] Appl. No.: 664,749

[22] Filed: Mar. 5, 1991

[51] Int. Cl.[5] ..... H01J 1/60; H05B 37/00; H05B 41/16

[52] U.S. Cl. ..... 315/130; 315/131; 315/136; 315/256; 315/315

[58] Field of Search ..... 340/642; 315/130, 131, 315/136, 256, 315

[56] References Cited

U.S. PATENT DOCUMENTS

| | | | |
|---|---|---|---|
| 4,295,079 | 10/1981 | Otsuka et al. | 315/130 |
| 4,396,868 | 8/1983 | Watanabe et al. | 315/130 |
| 4,449,073 | 5/1984 | Mongoven et al. | 315/130 |
| 4,939,505 | 7/1990 | Cappellini et al. | 340/642 |

FOREIGN PATENT DOCUMENTS

| | | | |
|---|---|---|---|
| 52-11020 | 3/1977 | Japan | 315/130 |
| 3-194898 | 8/1991 | Japan . | |
| 1506451 | 4/1978 | United Kingdom | 315/130 |

*Primary Examiner*—Eugene R. LaRoche
*Assistant Examiner*—Michael B. Shingleton
*Attorney, Agent, or Firm*—Foley & Lardner

[57] ABSTRACT

A plurality of current transformers connected in series provide secondary winding sides respectively connected to lamps. A constant-current source is provided to supply constant current to these lamps. Each lamp is connected to the corresponding terminal unit including a short-circuit switch for short-circuiting the secondary winding side of the transformer when the lamp is disconnected. A master station issues a request for detecting a disconnected lamp or checking whether or not failure occurs in the terminal unit to each terminal unit in the form of an instant power interruption. Each terminal unit has a proper identification time assigned thereto. In response to the request issued by the master station in the form of an instant power interruption, after the proper identification time for each terminal unit, the relevant terminal unit serves to turn off a short-circuit switch for opening the secondary winding side of the transformer for a predetermined time or, during the proper identification time, the terminal unit serves to control the short-circuit switch on and off according to a predetermined code to respond to the request issued by the master station. In the master station, the constant-current source reads the information from each terminal unit based on the waveform change of an output current and output voltage of the constant-current source so as to determine whether or not each lamp is disconnected, where the disconnected lamp is located, whether or not each terminal unit fails, and where the failed terminal unit is located.

6 Claims, 10 Drawing Sheets

LAMP CIRCUIT WITH DISCONNECTED LAMP DETECTING DEVICE

BACKGROUND OF THE INVENTION

1. Field of the Invention

The present invention relates to a lamp circuit having two or more lamps connected in series and more particularly, to a lamp circuit providing means for detecting a disconnected lamp.

2. Description of the Prior Art

One way of using of a series lamp circuit is for lighting an airport runway. A series lamp circuit includes two or more current transformers, each secondary winding of which is connected to the corresponding lamp and each primary winding of which is connected in series with each other. Those lamps are supplied by a constant current source through current transformers having primary windings connected in series so that the lamps are all lit at constant luminance.

The series lamp circuit provides a disconnected lamp detecting device which is capable of detecting a disconnected lamp on a power operation panel. A lamp circuit having such a series lamp circuit has been proposed in U.S. Pat. No. 4,295,079 and 4,396,868, for example.

These prior art, however, have no capability of detecting the location of a disconnected lamp(s) in the overall lamp system, though they are capable of detecting occurrence of a disconnected lamp and the number of disconnected lamps.

In order to overcome this shortcoming, there has been proposed a technique having a capability of detecting the number of disconnected lamps and the location of the disconnected lamps. This technique has been disclosed in Japanese Patent Application Laid Open No. Heisei 1-335292 (335292/1989).

In the disclosed art, the lamps respectively provide corresponding terminal units and are all connected to a common master station located on the power operation panel. Between each corresponding unit and the master station are provided load current circuits. The load current circuit is capable of detecting the number of disconnected lamps as well as the locations of the disconnected lamps on the power operation panel. This prior art, therefore, enables quickly replacing the disconnected lamp with a new one.

If a disconnected lamp occurs, however, an excess voltage appears in the secondary of the transformer connected with the lamp. The excess voltage often causes parts included in the corresponding terminal unit to fail. The failure results in disabling to carry out the essential function of the terminal unit.

SUMMARY OF THE INVENTION

It is therefore an object of the present invention to provide a lamp circuit with a disconnected lamp detecting device which is capable of diagnosing the number and the locations of disconnected lamps as well as the occurrence of each terminal unit.

In carrying out the object in a preferred mode, the present invention provides a lamp circuit which is designed as follows. The lamp circuit includes a plurality of current transformers connected in series, respective secondary windings of which are connected to lamps. A constant-current source supplies constant current to these lamps. Each lamp provides the corresponding terminal unit ($R_1$-$R_n$) having a short-circuit switch (22) for short-circuiting the secondary winding of the transformer if the lamp is disconnected. A master station supplies to each terminal unit a request for detecting a disconnected lamp and a request for diagnosing each terminal unit in the form of an instant power interruption. Each terminal unit has a proper Identification time assigned thereto. In response to an output request in the form of the instant power interruption, each terminal unit serves to open the secondary winding of the transformer for a predetermined time after the Identification time by using a short-circuit switch or turn on or off the transformer for the predetermined time depending on a predetermined code so that the master station receives the message from the terminal unit. The master station serves to read the message of each terminal unit depending on the waveform change of an output current and an output voltage of a constant-current source and on the basis of the message, determine whether or not each lamp is disconnected, where the disconnected lamp is located, and whether or not the corresponding terminal unit fails, based on the message.

DETAILED DESCRIPTION OF THE PREFERRED EMBODIMENTS

Figure 1:
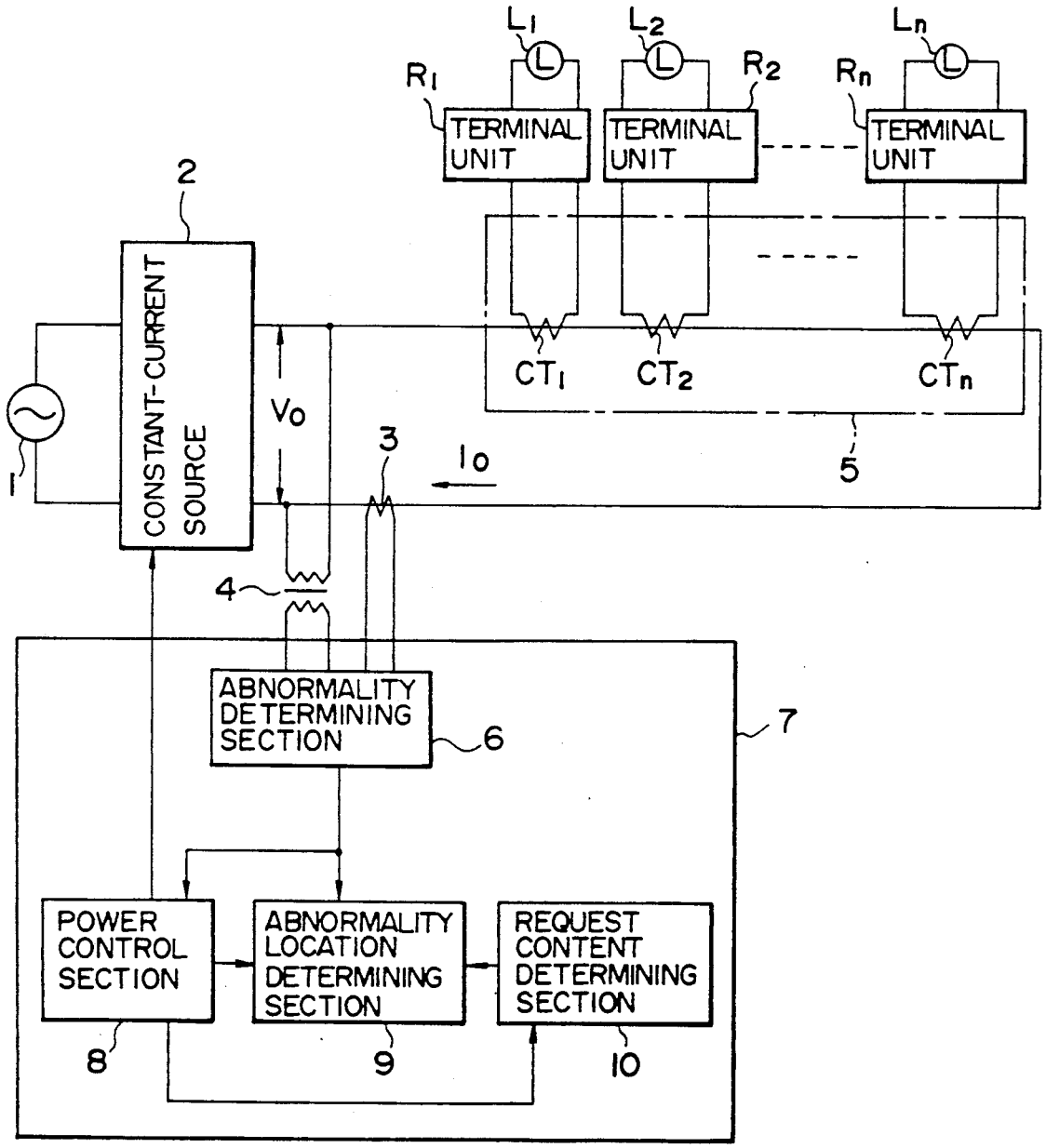
FIG. 1 is a block diagram showing a lamp circuit with a disconnected lamp detecting device according to an embodiment of the present invention.

FIG. 1 shows a lamp circuit according to an embodiment of the present invention. An a.c. power supply serves to supply constant current to a series lamp circuit 5 through a constant-current source 2. The constant-current source serves to output constant current depending on each phase. The series lamp circuit 5 includes a plurality of (1 to n) current transformers $CT_1$, $CT_2$, . . . , $CT_n$ having respective primary windings connected in series. The secondary windings of the transformers are connected to the lamps $L_1$, $L_2$, . . . , $L_n$ through terminal units $R_1$, $R_2$, . . . , $R_n$ in the one-to-one correspondency. The a.c. power supply serves to supply constant current through the constant-current source 2 and the transformers $CT_1$ to $CT_n$ to the lamps $L_1$ to $L_n$ so that each lamp is allowed to be kept at constant luminance. The constant current is controlled by adjusting an ignition angle of a thyristor, for example.

The output current $I_0$ and the output voltage $V_0$ of the constant-current source 2 are respectively detected by the current detector 3 and the voltage detector 4. The detected signals are sent to a master station 7.

The master station 7 includes an abnormality determining section 6, a power control section 8, an abnormality location determining section 9, and a request content determining section 10. The abnormality determining section 6 serves to determine the occurrence of any of the lamps $L_1, L_2, \ldots, L_n$ and output the determined result to the abnormality location determining section 9. The power control section 8 serves to control the output of the constant-current source 2 and to send out the determined result to the abnormality location determining section 9. The power control section 8 is designed to control the output of the constant-current source 2 and to instantly interrupt the power for such a cycle-order short time as giving no obstacle to lighting of the lamp each constant period at each constant period (for example, each ten minutes or each lower minutes than ten) or at each of any period, whether or not there exists a disconnected lamp. (This operation is referred to as instant power interruption). Instant power interruption is carried out once or more times within a predetermined time. The present embodiment is designed to carry out instant power interruption only once if the disconnected lamp is detected and twice if the failed terminal unit is detected.

The abnormality location determining section 9 stores the Identification times (referred to as ID time) $t_1, t_2, \ldots, t_n$ for the respective lamps. The abnormality location determining section 9 serves to compare the ID time with the time when a signal is sent from the abnormality determining section 6 to the abnormality location determining section 9 and determine where the disconnected lamp is located and where a normal or abnormal terminal unit is located.

The request content determining section 10 serves to detect how many times the instant power interruption is carried out in the constant-current source within a constant time on the basis of the signal sent from the power control section 8. Based on the detected times, the request content determining section 10 serves to determine whether or not the detection of a disconnected lamp is requested or whether or not the diagnosis of the terminal unit is requested.

Next, the description will be directed to the arrangements of the terminal units $R_1, R_2, \ldots, R_n$ These terminal units have the same arrangement. Herein, hence, the terminal unit $R_1$ is described as a representative one with reference to FIG. 2.

Figure 2:
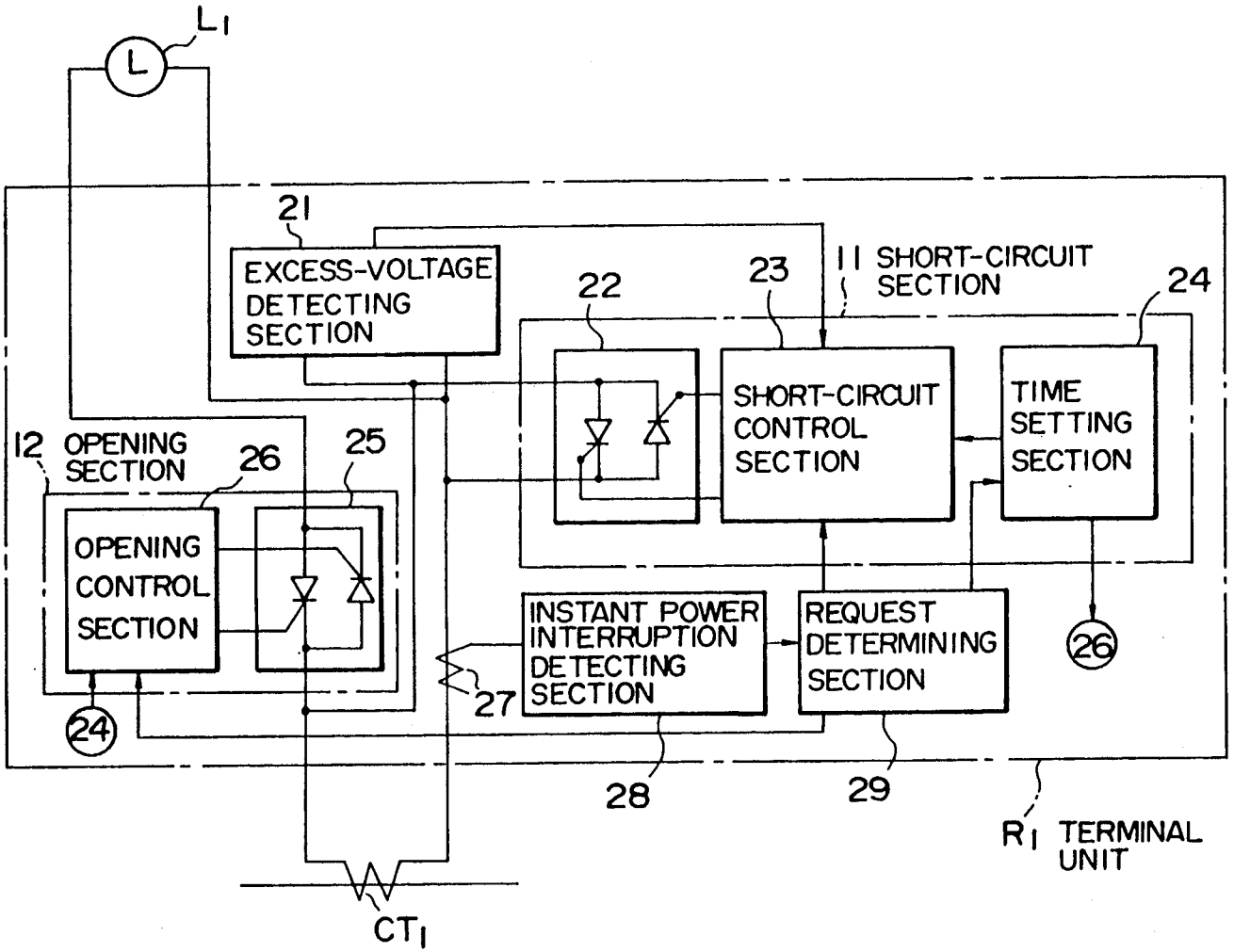
FIG. 2 is a block diagram showing arrangement of a terminal unit located in the lamp circuit shown in FIG. 1.

In FIG. 2, the secondary winding of the transformer $CT_1$ is connected to the lamp $L_1$ through a switch 25 included in an opening section. 11 denotes a short-circuit section which has a switch 22 connected in parallel with the secondary winding of the transformer $CT_1$. Each of the switches 22, 25 consists of a pair of thyristors connected in antiparallel.

The short-circuit section 11 includes the switch 22 which is kept off in normal conditions and turned on when the disconnected lamp is detected, a time setting section 24 for setting an ID time t, and a short-circuit control section for controlling the switch 22 to be turned off for a constant time T after the ID time has passed. The ID time set in the time setting section 24 has a respective duration for the terminal units such that $t_1 < t_2 < t \ldots < t_n$ for the corresponding terminal units $R_1, R_2, \ldots, R_n$.

The opening section 12 includes the switch 25 which is kept on in normal conditions and an opening control section 26 for turning off the switch 25. The secondary side of the transformer $CT_1$ is connected to a current transformer 27. An instant power interruption detecting section 28 serves to detect the times of the instant power interruption of the constant-current source 2 on the basis of the current detected through the transformer 27. Based on the times of the instant power interruption detected within a constant time, a request determining section 29 serves to determine if the instant power interruption requests to detect a disconnected lamp or it requests to diagnose the terminal units and then output the determining signal to the short-circuit control section 23 or the opening control section 26. If the instant power interruption is carried out once, the request determining section 29 determines that the instant power interruption requests to detect a disconnected lamp and outputs the determining signal to the short-circuit control section 23. If the instant power interruption is carried out twice or more, the request determining section 29 determines that the instant power interruption requests to diagnose the terminal unit, that is, check whether or not the terminal unit fails and outputs the determining signal to the opening control section 26.

Next, the description will be directed to how the device shown in FIGS. 1 and 2 operates.

Assume that the lamp $L_1$ is disconnected. The secondary winding of the transformer $CT_1$ is left open so that an excess voltage takes place. The excess voltage detecting section 21 detects the excess voltage and sends the detection signal as a disconnected lamp detecting signal to the short-circuit control section 23 of the short-circuit section 11.

In response to the signal, the short-circuit control section 23 operates to turn the switch 22 on for short-circuiting the secondary winding of the transformer $CT_1$, resulting in disallowing the abnormality determining section 6 to detect the disconnection of the lamp $L_1$.

Figure 3:
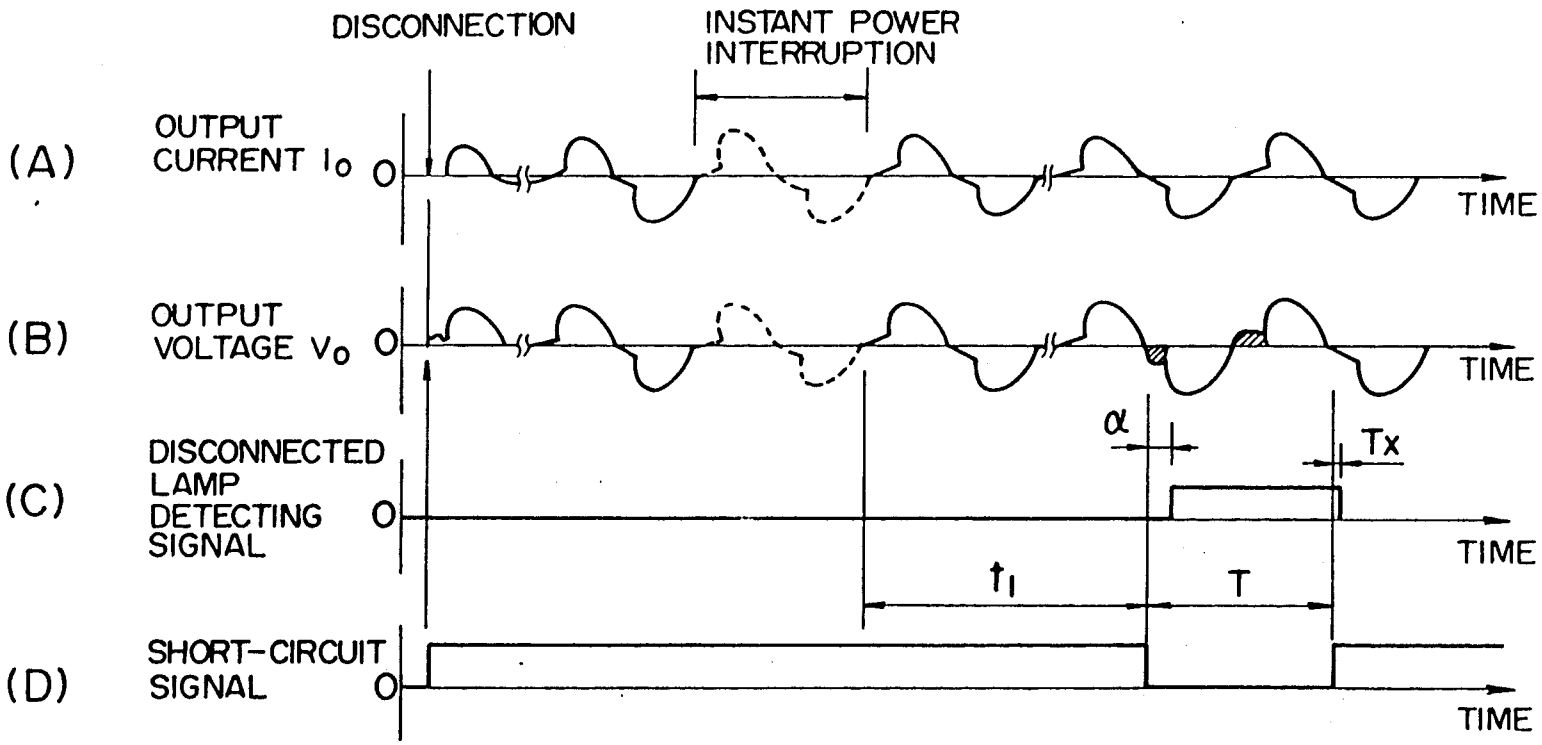
FIGS. 3 and 4 are a time chart for describing the operation of the lamp circuit shown in FIGS. 1 and 2.

On the other hand, as mentioned above, if the power control section 8 included in the master station 7 serves to instantly interrupt power once for a constant time (for example, one cycle), the output current $I_0$ (see FIG. 3(A)) and the output voltage $V_0$ (see FIG. 3(B)) supplied from the constant-current source 2 are made zero as shown in a dotted line of FIG. 3.

The instant power interruption detecting section 28 detects the instant power interruption through the transformer 27 and outputs the detection signal to the request determining section 29. The request determining section 29 monitors the instant power interruption for a constant time after the first instant power interruption. Then, since the instant power interruption is carried out once for the constant time, the request determining section 29 determines that the instant power interruption requests to detect whether or not the lamp is disconnected and outputs the determining signal to the short-circuit control section 23.

In response to the determining signal, the short-circuit control section 23 outputs to the switch 22 a short-circuit control signal after the ID time $t_1$ set by the time setting section 24 has passed, for the purpose of releasing the short-circuit for the time T (see FIG. 3(D)). The releasing operation is carried out after the instant power interruption. This is because it is necessary to synchronize the time when counting each ID time $t_n$ for when the corresponding lamp is started with the zero-point time when the one-cycle waveform is started.

When the short-circuit is released, the waveform of the output voltage $V_0$ is changed by the disconnection of the lamp $L_1$. In the master station 7, the abnormality determining section 6 detects the change with a time integrating method (that is, the section 6 integrates the area shown by oblique lines (see U.S. Pat. No. 4,295,079)) and determines that the lamp is disconnected. The detection for the disconnected lamp is later than the short-circuit releasing time only by the saturation time $\alpha$ of the transformer $CT_1$.

Next, the abnormality location determining section 9 serves to obtain the time between the time when the power control section 8 performs the instant power interruption and the time when the abnormality determining section 6 detects the disconnection of the lamp and subtracts the saturation time $\alpha$ from the obtained time. Then, the abnormality location determining section 9 serves to compare the resulting time with each pre-stored ID time $t_1, t_2, \ldots, t_n$ for each lamp. If it matches to the ID time $t_1$, the section 9 determines that the lamp $L_1$ is disconnected.

If the lamp $L_2$ is disconnected, the terminal unit $R_2$ serves to short-circuit the secondary winding of the transformer $CT_2$ the short-circuit for only the time T after the IT time $t_2$ set by the time setting section 24 has passed since the instant power interruption. The abnormality location determining section 9 obtains the time between the time when the power control section 8 carries out the instant power interruption and the time when the disconnected lamp is detected, and subtracts the saturation time $\alpha$ from the obtained time. If the resulting time matches the ID time $t_2$, the abnormality location determining section 9 determines that the lamp $L_2$ is disconnected.

Herein, the duration of the ID time $t_2$ is set to larger than $t_1+T+T_x$ (where $T_x$ denotes a return time Of the abnormality determining section 6 as shown in FIG. 3(C)), because if two or more lamps are disconnected, it is possible to avoid overlapping of each short-circuit releasing time T. Likewise, the time ID time $t_3$ set for the terminal unit $R_3$ is such that $t_n > t_{n-1}+T+T_x$.

As mentioned above, by setting the ID time $t_n$ for each lamp, it is possible to detect even the concurrent disconnection of the lamps $L_1$ and $L_2$. That is, if the lamps $L_1$ and $L_2$ are disconnected at a time, the secondary windings of the transformers $CT_1$ and $CT_2$ are short-circuited in the terminal units $R_1$ and $R_2$. Then, the power control section 8 operates to perform the instant power interruption for both of the lamps at a time. After the ID times $t_1$ and $t_2$ have passed, the secondary windings of the transformers $CT_1$ and $CT_2$ are returned to the original state for only a time T without overlapping the released times. The abnormality location determining section 9 serves to compare the time from instant power interruption to the detection of the disconnected lamp with the pre-stored ID time t and determine that the lamps $L_1$ and $L_2$ are disconnected on the basis of the compared result.

Next, the description will be directed to how the terminal unit is diagnosed. For this purpose, the power control section 8 operates to carry out the instant power interruption twice for a constant time so that the output current $I_0$ (see FIG. 4(A)) and the output voltage $V_0$ (see FIG. 4(B)) are made zero at each of the two instant power interruptions.

The instant power interruption detecting section 28 detects these two instant power interruptions through the transformer 27 and outputs the detection signal to the request determining section 29. Since the instant power interruption is carried out twice for a constant time, the request determining section 29 determines that the instant power interruption requests to diagnose the terminal unit and output the determining signal to the opening control section 26.

Figure 4:
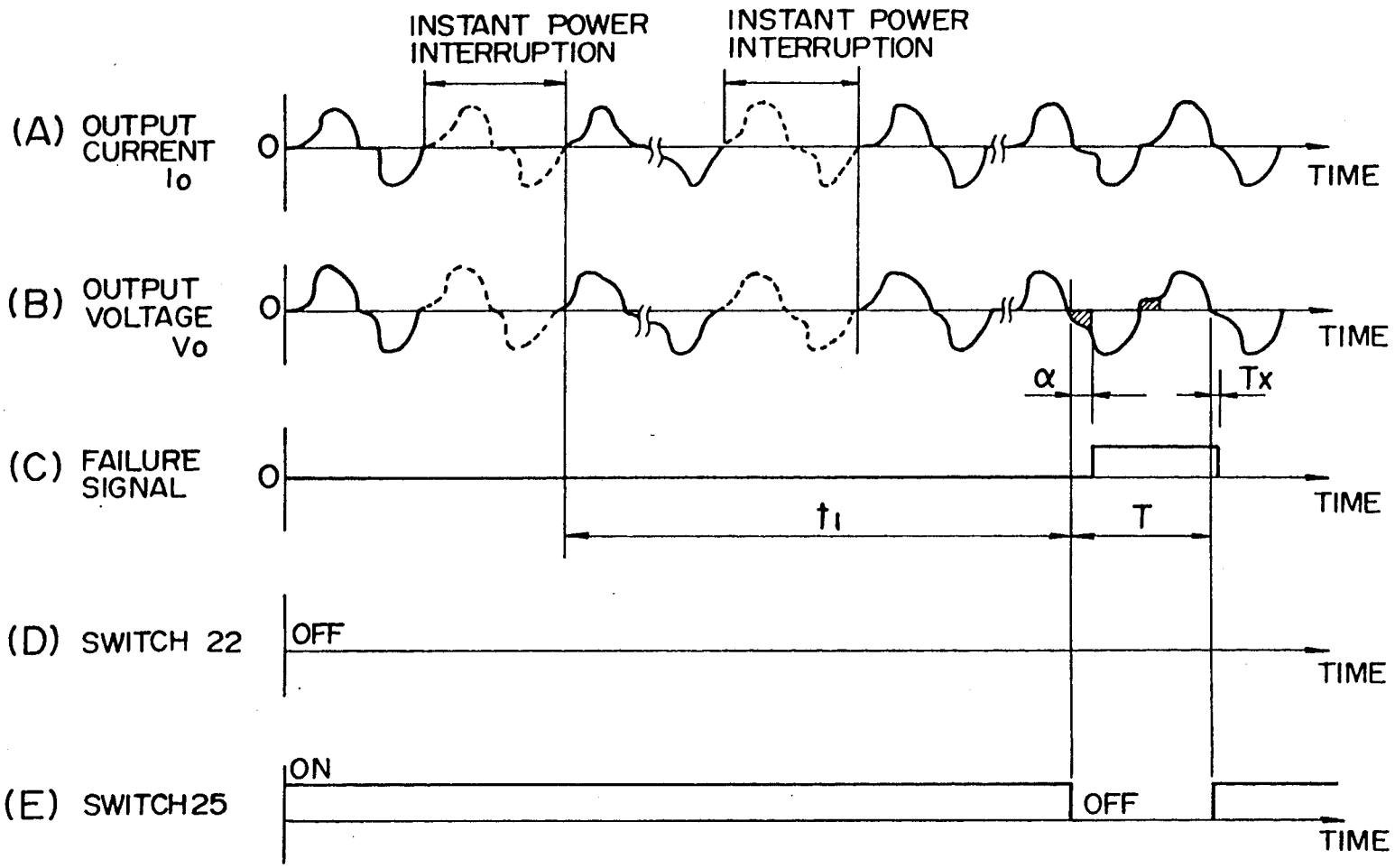

After the ID time $t_1$ has passed, the opening control section 26, as shown in FIG. 4(E), turn off the switch 25 under the condition of the second instant power interruption.

When the switch 25 is turned off, as shown in FIG. 4(B), the waveform of the output voltage supplied by the constant-current source 2 is changed. In the master station 7, the abnormality determining section 6 detects the change with the foregoing time integrating method and determines that the terminal unit $R_1$ operates normally, based on the detected change. On the other hand, if the waveform of the output voltage supplied by the constant current power device 2 is not changed though the switch 25 is turned off, the abnormality determining section 6 determines that the terminal unit $R_1$ operates abnormally.

Next, the abnormality location determining section 9 serves to specify one of the terminal units $R_1$ to $R_n$ relevant to the diagnosis signal sent from the abnormality determining section 6. How it specifies the terminal unit is the same as how the disconnection of the lamp $L_1$ is detected as mentioned above. Hence, the description about it is omitted here.

As set forth above, the device shown in FIGS. 1 and 2 is capable of precisely determining which lamp is disconnected and which terminal unit fails by merely carrying out the instant power interruption in the constant-current source 2 based on the command sent from the master station 7. It results in providing more efficient maintenance and checking of the lamp circuit.

In case the instant power interruptions are carried out in shorter periods, it takes shorter time after occurrence of the disconnected lamp to detect the disconnection of the lamp. In case a lamp is disconnected, the present lamp circuit is designed to short-circuit the secondary side of the transformer as if the lamp had not been disconnected and release the short-circuit for only a short time T at each constant period. It results in preventing a high voltage from being brought about in the secondary winding of the transformer for a long time, thereby preventing the short-circuit caused between the windings of the transformer or burn-out of the winding due to the rise in temperature.

Figure 5:
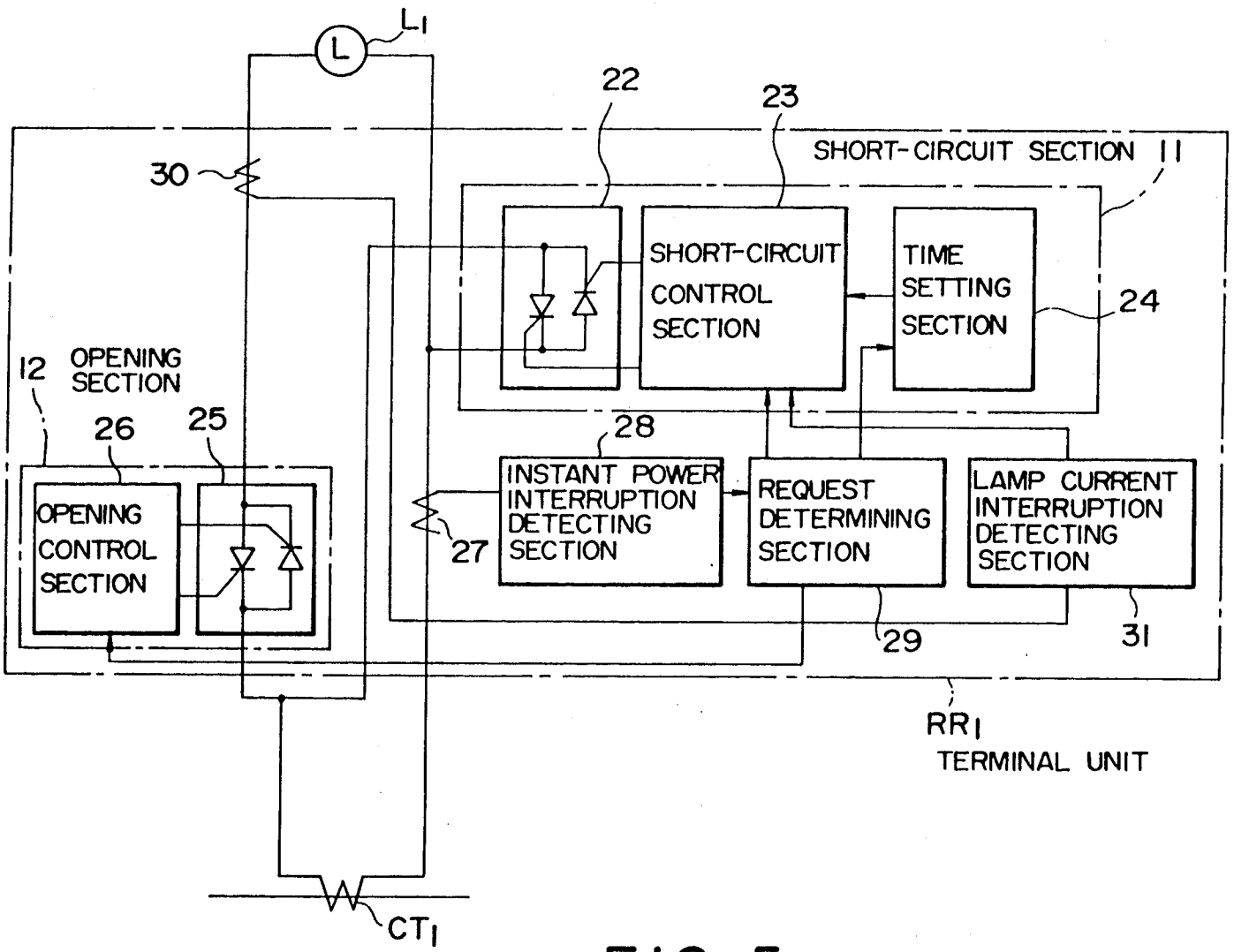
FIG. 5 is a block diagram showing a terminal unit according to another embodiment of the present invention.

In turn, the description will be directed to another embodiment, which has the different arrangement of the terminal units $R_1, R_2, \ldots, R_n$ rather than the foregoing embodiment (see FIG. 2). The present new embodiment is illustrated as a representative terminal $RR_1$ as shown in FIG. 5; The terminal unit $R_1$ shown in FIG. 2 has been designed so that the excess voltage detecting section 21 enables the detection of the occurrence of the disconnection based on the excess voltage appearing on the secondary winding of the transformer $CT_1$. On the other hand, the terminal unit $RR_1$ is designed so that a lamp current interruption detecting section 31 serves to detect the disconnection of the current of the lamp through the effect of the transformer 30 connected in series with the lamp $L_1$. The other arrangement of the terminal unit $RR_1$ is same as the foregoing terminal unit $R_1$.

The embodiments shown in FIGS. 2 and 5 use thyristors as a switching element for short-circuiting or opening the secondary winding of the transformer. They may use another switching element such as a triac. The instant power interruption to be performed by the power control section 8 is not required to be automated at each constant period in normal conditions. For example, the instant power interruptions may be brought about at several minutes' intervals at each integer time. Or, it may be manually brought about by an operator when he or she would like to detect the disconnection of the lamp. The instant power interruptions to be carried out within a constant time may be periodic or random.

Figure 6:
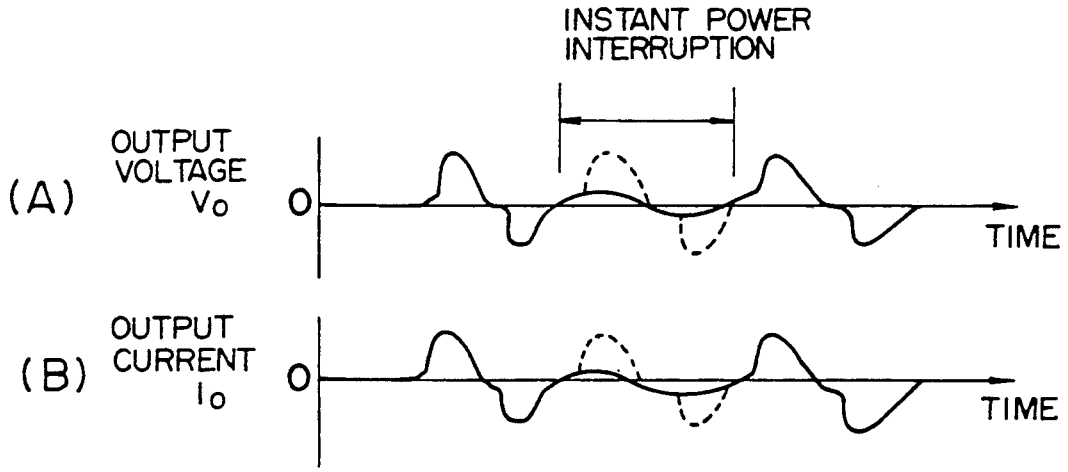
FIG. 6 is a chart showing waveforms of an output voltage and an output current supplied by another constant current power device unlike that shown in FIG. 1.

As mentioned above, the foregoing embodiment has been designed so that the instant power interruption to be done by the power control section 8 causes the output voltage and current of the constant-current source 2 to be zero. In general, however, the constant current power device for the lamp circuit includes a main power source for lighting the lamp and an auxiliary power source for supplying base current in a manner to allow a time-integrated value to be obtained when the lamp is disconnected. Hence, the instant power interruption may be designed to make only the output of the main power source zero and give a positive value to the output of the auxiliary power source. The instant power interruption so designed has the waveforms of the output voltage $V_0$ and the output current $I_0$ as shown in FIG. 6.

The aforementioned embodiments have been arranged so that they are capable of specifying the location of the disconnected lamp among two or more lamps and the location of the failed terminal unit among two or more terminal units by using the times of the instant power interruption of the a.c. power source. Hence, those embodiments do not require an operator to cyclically check the airport runaway for a disconnected lamp or a failed terminal unit, resulting in providing more efficient maintenance. Furthermore, those embodiments so designed are capable of preventing a high voltage from being applied to the transformer for a long time as a result of disconnecting the lamp, thereby preventing short-circuit or burn-out of the windings of the transformer.

Figure 7:
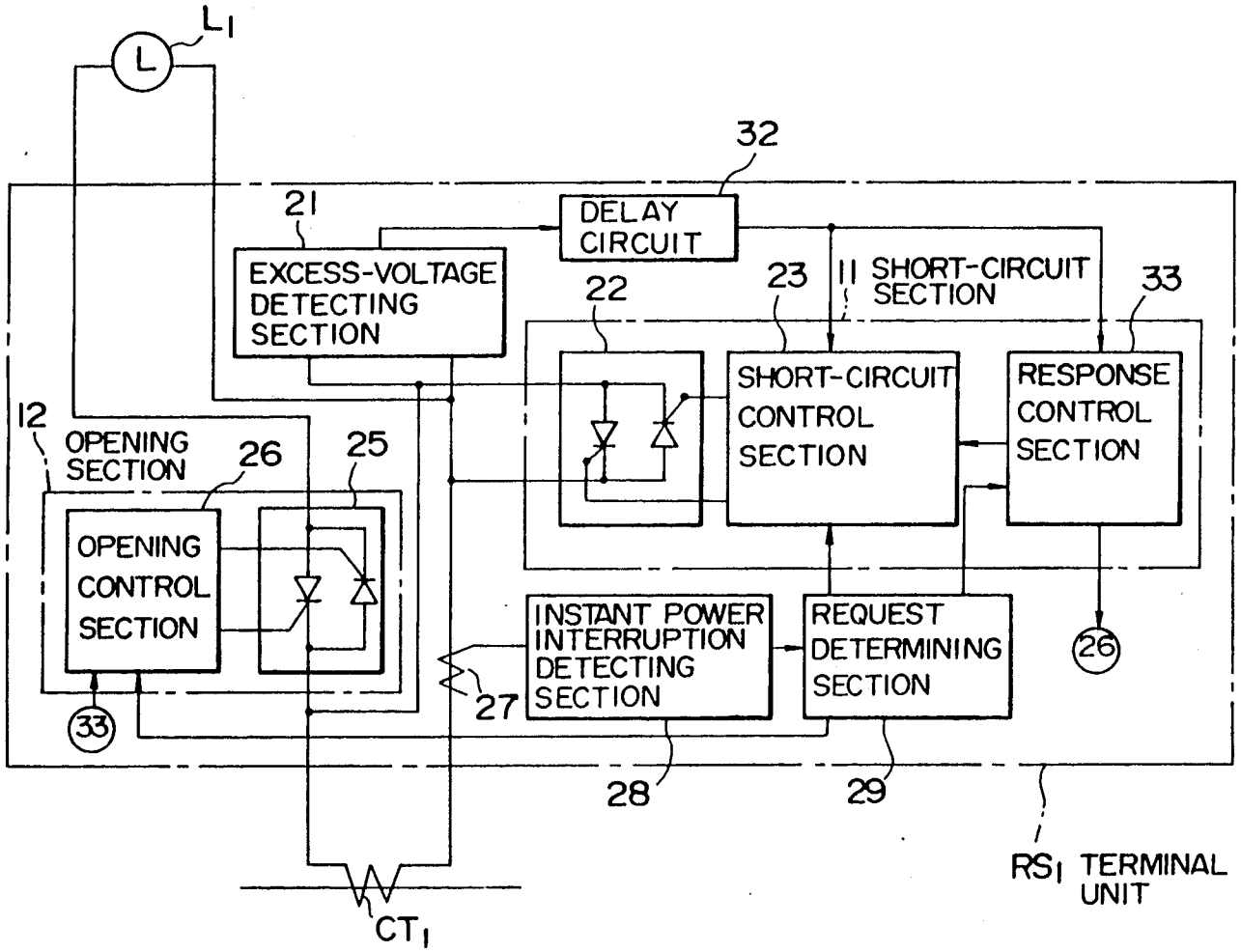
FIG. 7 is a block diagram showing a terminal unit according to another embodiment.

In turn, the description will be directed to another embodiment which uses a code signal for a response issued by the terminal unit in response to the disconnected lamp detecting request or the terminal unit diagnosis request from the master station 7 with reference to FIG. 7.

According to the present embodiment, when the excess voltage detecting section 21 detects the opening of the secondary winding of the transformer $CT_1$, that is, the disconnection of the lamp $L_1$, the excess voltage detecting section 21 sends out the disconnected lamp detecting signal to a short-circuit control section 23 and a response control section 33 through a delay circuit 32 having a delay time matching to some cycles based on the power frequency. The short-circuit control section 23 receives the disconnected lamp detecting signal through the delay circuit 32. It is thus capable of short-circuiting the secondary winding of the transformer $CT_1$ by changing the off-state switch 22 to an on-state. The response control section 33 has an ID time $t_1, t_2 \ldots, t_n$ for each terminal unit, that is, an ID time having a proper value for each terminal unit. These ID times are required because not only the terminal unit $RS_1$ but also the other terminal units serially send out to the master station the response signal according to the terminal unit number. Furthermore, herein, the instant power interruption for requesting the detection of the disconnected lamp 19 set to be performed in a half cycle (see a broken line of FIG. 8(A)) and the instant power interruption of requesting the diagnosis of the terminal unit is set to be done in one cycle (see a broken line of FIG. 9(A)). The instant power interruption detecting section 28 and the request determining section 29 determine the request content sent by the master station 7.

Figure 10:
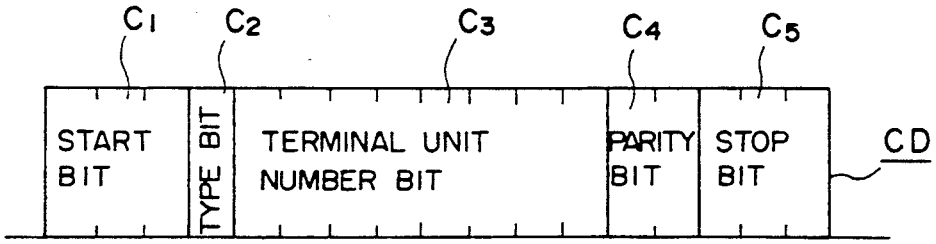
FIG. 10 is a view showing an arrangement of a code signal used in the terminal unit shown in FIG. 7.

According to the present embodiment, the request determining section 29 serves to detect the content requested by the instant power interruption of the detecting current, that is, the half-cycle interruption or the one-cycle interruption on the basis of the secondary current of the transformer $CT_1$ detected by the transformer 27. The half-cycle interruption is for requesting the location of disconnected lamp or for requesting the terminal unit diagnosis. Then, the request determining section 29 notifies the response control section 33 of the determined result. In case the determined result is for requesting the location of the disconnected lamp, the response control section 33 serves to increment a count at each half cycle of the a.c. power supply 1 on the condition that it receives a disconnected lamp detecting signal from the excess voltage detecting section 21. When the counted time reaches the ID time t, the response control section 33 serves to control the switch 25 to turn off through the opening control section 26 and the switch 22 to turn on and off according to the code signal CD arranged as shown in FIG. 10. In case the determined result is for requesting the diagnosis of the terminal unit, the response control section 33 serves to increment a count at each half cycle of the a.c. power source 1 whether the disconnected lamp detecting signal is received or not. When the counted time reaches the ID time t, the response control section 33 serves to similarly perform the above operation.

FIG. 10 shows an example of a code signal CD. As shown, the code signal CD consists of a three-bit start bit $C_1$, a one-bit type bit $C_2$, an eight-bit terminal unit number bit $C_3$, a two-bit parity bit $C_4$, and a three-bit stop bit $C_5$. The type bit indicates a type of the terminal output in the manner where "0" means the detection of the disconnected lamp and "1" means the diagnosis of that terminal unit. As will be obvious from the title, the terminal unit number bit $C_3$ indicates the terminal unit number. Herein, the bit $C_3$ consists of eight bits. Hence, the present embodiment assumes that the terminal units to be separated are as many as $2^8-1=255$. The other start bit $C_1$, parity bit $C_4$, and three-bit stop bit $C_5$ are well known.

Figure 11:
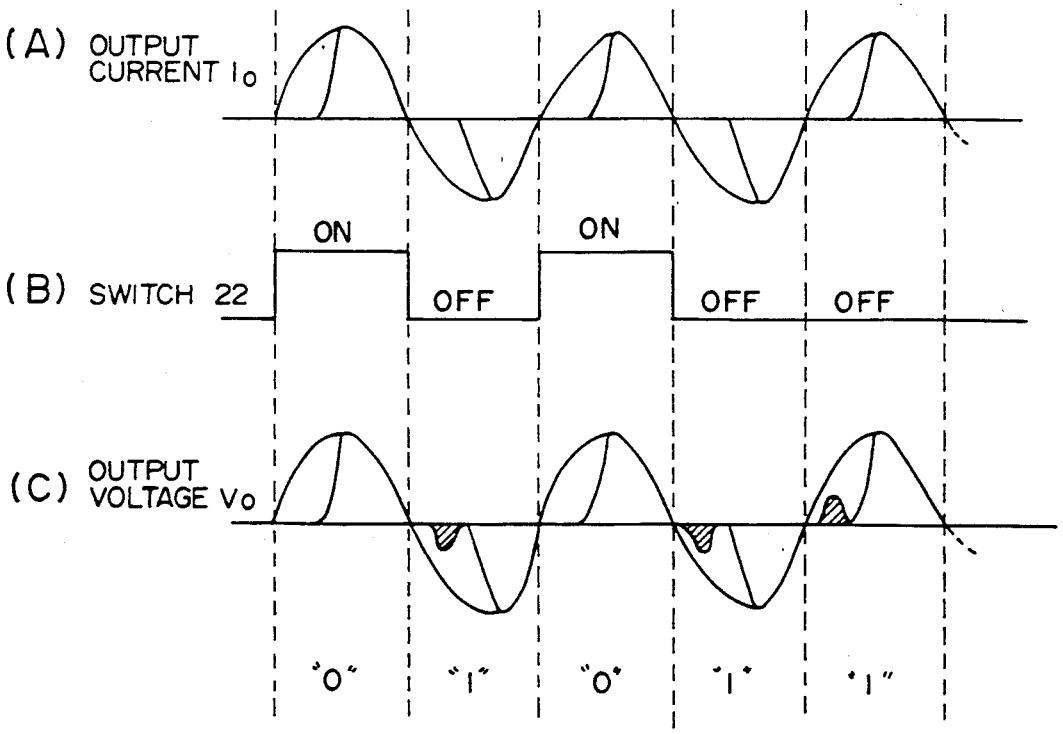
FIG. 11 is a time chart showing an output current and an output voltage appearing when the terminal unit supplies an on-off code signal from the terminal unit to the master station.

FIG. 11 shows the waveform of an output current $I_0$ given when the terminal unit responds to the master station by turning the switch 22 on and off, how the switch 22 is turned on and off, and how the waveform of an output voltage $V_0$ corresponds to the on and off control of the switch 22. When the switch 22 is in an on state, no saturation is caused in the transformer (for example, $CT_1$). Hence, the output voltage $V_0$ corresponds to the output current $I_0$. For such a case, the content of an on and off code is interpreted as "0". When the switch 22 is in an off state, as mentioned above, a saturation phenomenon is brought about in the transformer, thereby causing the output voltage $V_0$ to be shaped to have a "mountain" as shown by hatching in addition to the waveform portion corresponding to the output current $I_0$. The master station 7 detects the "mountain", resulting in the content of the on and off code of the switch 22 being interpreted as "1".

In the unit shown in FIG. 7, in case no lamps $L_1$ to $L_n$ are disconnected, that is, all the lamps are in normal conditions, the switch 25 is in an on state and the switch 22 is in an off state. In case any lamp is disconnected, the excess voltage detecting section 21 for the lamp detects the disconnection. The switch 22 is forced to be on through the effect of the delay circuit 22 and the short-circuit control section 23. The fact that the lamp is disconnected is stored in the response control section 33.

When the master station 7 issues a request for terminal output, the request signal is transmitted to each terminal unit in the form of the instant power interruption done in a half cycle (see FIG. 8(A)) and one cycle (see FIG. 9(A)) through the constant-current source 2. The instant power interruption is identified by the instant power interruption detecting section 28 and the request determining section 29 in each terminal unit $R_1$ to $R_n$. That is, it is identified if the instant power interruption requests to detect a disconnected lamp or diagnose a terminal unit.

Figure 8:
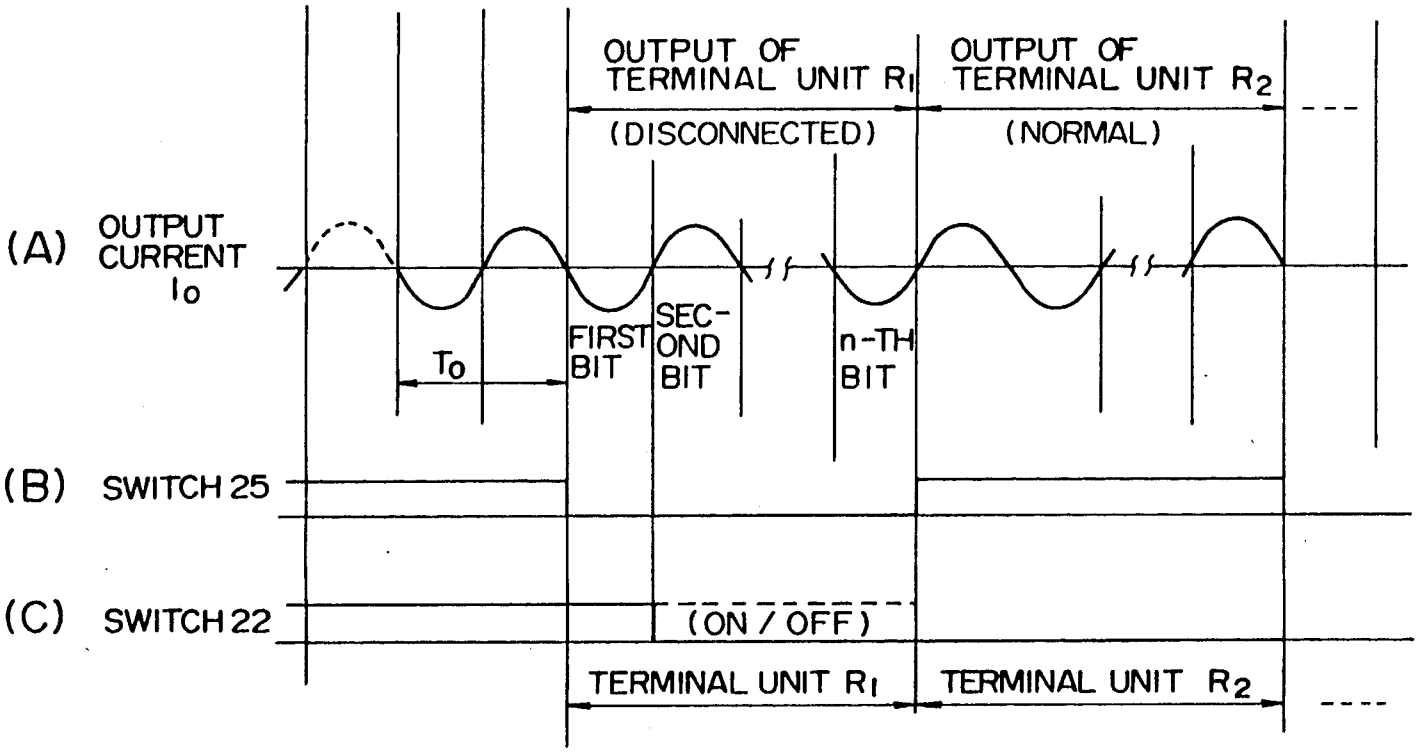
FIGS. 8 and 9 are time charts for describing how the terminal unit shown in FIG. 7 operates.

FIG. 8 is depicted on the assumption that the disconnected lamp is the lamp $L_1$ belonging to the first terminal unit $R_1$. Assuming that the lamps relevant to the terminal unit $R_2$ or later are not disconnected, the terminal units $R_2$ or later serve to supply a response signal having all bits of zero as a code signal CD shown in FIG. 10.

Figure 9:
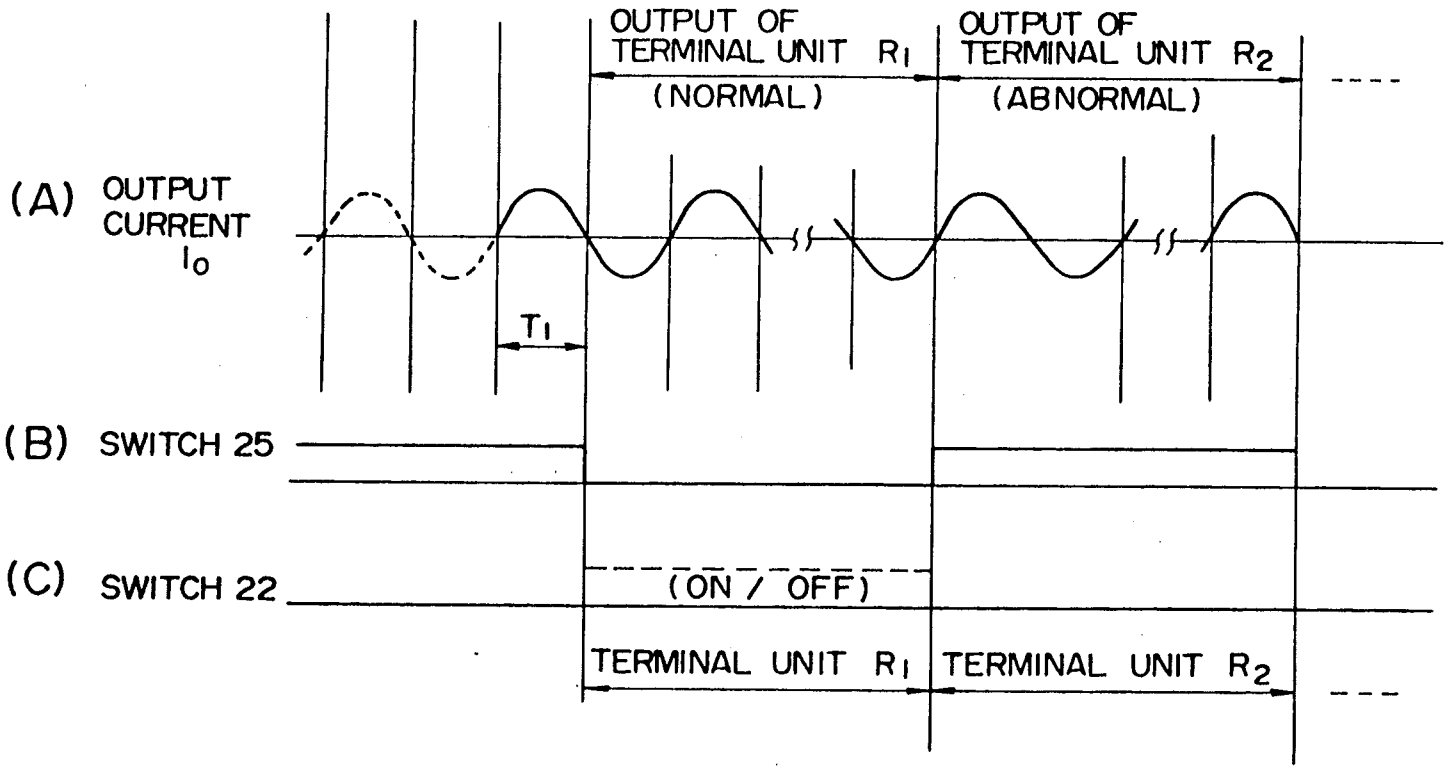

Next, consider that the request determining section 29 determines that the instant power interruption requests to diagnose the terminal unit. When the master station 7 issues a request for diagnosing the terminal unit to the response control section 33, after the proper ID time for each terminal unit has passed, the response control unit 33 serves to turn the switch 25 off through the opening control section 33 for the purpose of virtually disconnecting the lamp. Then, a half cycle later than the time when the switch 25 is turned off, the opening control section 33 serves to control the switch 22 depending on the code signal shown in FIG. 10. In case the terminal unit operates normally, the type bit $C_2$ is "0". FIG. 9 is depicted on the assumption that the first terminal unit $R_1$ operates normally but the second terminal unit operates abnormally.

The master station (see FIG. 1) monitors the output voltage $V_0$ and the output current $I_0$ of the constant current power device and makes sure of the response content of each terminal unit based on the on and off control of the switch 22. That is, the abnormality determining section 6 receives the on-and-off code signal CD shown in FIG. 10. Then, the abnormality determining section 6 determines whether or not the type bit $C_2$ of the signal CD is "0" and checks the start bit $C_1$, the stop bit $C_5$, and the parity bit $C_4$. If no error is found in these bits, the code signal CD is sent out to the abnormality location determining section 9 (see FIG. 1). The abnormality location determining section 9 picks up the terminal unit number out of the code signal CD in order to specify the terminal unit connected to the disconnected lamp. If all of the bits included in the code signal indicate "0", the abnormality location determining section 9 determines that no lamp is disconnected. If the type bit $C_2$ is "1", the abnormality location determining section 9 interprets the CD code as a terminal unit normal code. Then, it checks the start bit $C_1$, the stop bit $C_5$, and the parity bit $C_4$ for any error. If no error is found, the abnormality location determining section 9 picks up the terminal unit number out of the code signal CD and determines that the terminal unit with the picked-up number operates normally. If all the bits included in the code signal CD are zero, the abnormality determining section 9 determines that the terminal unit with the picked-up number is operating abnormally.

As set forth above, the present embodiment is capable of implementing communication between each terminal unit and the master station with a code signal. It results in improving reliability of the response between each terminal unit and the master station.

The present embodiment (see FIG. 7) has been designed so that the instant power interruption for the request for searching the disconnected lamp is carried out in a half cycle and that for the request for diagnosing the terminal unit is carried out in one cycle. However, it goes without saying that the present invention is not limited so. For example, it may be possible to arrange the instant power interruption so that the former case is carried out in one cycle and the latter case is carried out in two cycles.

What is claimed is:

1. A lamp circuit with disconnected lamp detecting device, said lamp circuit comprising;

a constant-current source, a plurality of current transformers respectively providing pairs of a primary winding and a secondary winding, said primary windings being connected in series with said constant-current source, a plurality of lamps, each of said lamps being connected to each of said secondary windings provided in said plurality of transformers, power control means operative to instantly interrupt said constant-current source at a first mode for requesting a detecting output of a disconnected lamp and at a second mode for requesting diagnosis output of a terminal unit, a plurality of terminal units, each of said terminal units including, a first switch connected in parallel with said secondary winding of each transformer and being normally kept in an off state, a second switch connected in series with said lamp and being normally kept in an on state, opening state detecting means for detecting an opening state of said secondary winding side of each transformer, request determining means for monitoring secondary current flow in said transformer for the purpose of determining if the instant power interruption of the secondary current indicates the first mode or the second mode, short-circuit control means for turning on said first switch in response to the detection signal sent from said opening state detecting means and, if said request determining means determines that the instant power interruption indicates the first mode, turning off said first switch for a predetermined time after a proper identification time for said each terminal unit, and means for, if said request determining means determines that the instant power interruption indicates the second mode, turning off said second switch for a predetermined time after a proper identification time for said each terminal unit, and determining means for determining whether or not each lamp is disconnected, where the disconnected lamp is located, whether or not each terminal unit fails, and where the failed terminal unit is located, based on the waveforms of an output voltage and an output current of said constant current at a time point when the proper Identification time for each lamp has passed after the occurrence of the instant power interruption.

2. The lamp circuit according to claim 1, wherein said disconnected lamp detecting means serves to detect an excess voltage appearing as a result of opening the secondary side of the transformer.

3. The lamp circuit according to claim 1, wherein said disconnected lamp detecting means serves to detect the interruption of current flown through the lamp as a result of opening the secondary side of the transformer.

4. A lamp circuit with disconnected lamp detecting device, said lamp circuit comprising;

a constant-current source, a plurality of current transformers respectively providing pairs of a primary winding and a secondary winding, said primary windings being connected in series with said constant current power device, a plurality of lamps, each of said lamps being connected to each of said secondary windings provided in said plurality of transformers, power control means operative to instantly interrupt said constant-current source at a first mode for requesting a detecting output of a disconnected lamp and at a second mode for requesting a diagnosis output of a terminal unit, a plurality of terminal units, each of said terminal units including, a first switch connected in parallel with said secondary winding of each transformer and being normally kept in an off state, a second switch connected in series with said lamp and being normally kept in an on state, opening state detecting means for detecting an opening state of said secondary winding side of each transformer, request determining means for monitoring secondary current flown in said transformer for the purpose of determining if the instant power interruption of the secondary current indicates the first mode or the second mode, short-circuit control means for turning on said first switch in response to the detection signal sent from said opening state detecting means and turning off said first switch for a predetermined time after a proper identification time for said each terminal unit according to a predetermined code, based on the content determined by said request determining means and the detecting result of said opening state detecting means, and means for, if said request determining means determines if the instant power interruption indicates the first or second mode, turning off said second switch for a predetermined time after a proper identification time for said each terminal unit, and determining means for determining whether or not each lamp is disconnected, where the disconnected lamp is located, whether or not each terminal unit fails, and where the failed terminal unit is located, based on the waveforms of an output voltage and an output current of said constant current at a time point when the proper Identification time for each lamp has passed after the occurrence of the instant power interruption.

5. The lamp circuit according to claim 4, wherein said disconnected lamp detecting means serves to detect an excess voltage appearing as a result of opening the secondary side of the transformer.

6. The lamp circuit according to claim 4, wherein said disconnected lamp detecting means serves to detect the interruption of current flown through the lamp as a result of opening the secondary side of the transformer.

* * * * *